US009062839B1

(12) United States Patent
Elder

(10) Patent No.: US 9,062,839 B1
(45) Date of Patent: Jun. 23, 2015

(54) SELECTIVELY ILLUMINABLE DECORATIVE FIXTURE ASSEMBLIES FOR POOLS, SPAS AND FOUNTAINS

(71) Applicant: David W. Elder, Coral Springs, FL (US)

(72) Inventor: David W. Elder, Coral Springs, FL (US)

(73) Assignee: WATER WORKS TECHNOLOGIES GROUP, LLC, Pompano Beach, FL (US)

( * ) Notice: Subject to any disclaimer, the term of this patent is extended or adjusted under 35 U.S.C. 154(b) by 0 days.

(21) Appl. No.: 14/523,720

(22) Filed: Oct. 24, 2014

(51) Int. Cl.

| | |
|---|---|
| ***B05B 17/08*** | (2006.01) |
| ***F21S 8/00*** | (2006.01) |
| ***F21S 10/00*** | (2006.01) |
| *F21W 121/02* | (2006.01) |
| *F21W 131/401* | (2006.01) |

(52) U.S. Cl.
CPC ..... *F21S 8/03* (2013.01); *F21S 10/002* (2013.01); *B05B 17/08* (2013.01); *F21W 2121/02* (2013.01); *F21W 2131/401* (2013.01)

(58) Field of Classification Search
CPC ..... B05B 17/08; F21S 8/00; E03C 1/0407
USPC ..... 362/101; 239/17, 18
See application file for complete search history.

(56) References Cited

U.S. PATENT DOCUMENTS

| | | | | |
|---|---|---|---|---|
| 2,604,414 | A | 7/1952 | Pike | |
| 4,591,094 | A | 5/1986 | Morris | |
| 6,030,108 | A | 2/2000 | Ishiharada et al. | |
| 6,393,192 | B1 | 5/2002 | Koren | |
| 6,644,561 | B1 * | 11/2003 | Daane | 239/18 |
| 6,871,793 | B2 * | 3/2005 | Rumens et al. | 239/16 |
| 7,819,541 | B2 | 10/2010 | Kunkel | |
| 2007/0084945 | A1 * | 4/2007 | Wei | 239/18 |
| 2008/0164336 | A1 * | 7/2008 | Kunkel | 239/18 |
| 2009/0250528 | A1 * | 10/2009 | Schnuckle | 239/18 |
| 2011/0138661 | A1 | 6/2011 | Fuller et al. | |
| 2013/0320107 | A1 * | 12/2013 | Yeiser, IV | 239/17 |
| 2014/0117107 | A1 | 5/2014 | Vogtner et al. | |

FOREIGN PATENT DOCUMENTS

| | | |
|---|---|---|
| DE | 4203107 A1 | 4/1992 |
| EP | 0497506 A2 | 1/1992 |

OTHER PUBLICATIONS

Crown Fountain, Article,2004.

* cited by examiner

*Primary Examiner* — Karabi Guharay
(74) *Attorney, Agent, or Firm* — Gold & Rizvi, P.A.; Glenn E. Gold

(57) ABSTRACT

A selectively-illuminable decorative water feature in the form of an assembly includes a base, casing, and a light source in communication with a semi-translucent or translucent fixture. The base may, for example, be a portion of a component/feature of a swimming pool, a spa or a fountain. The casing and light source may be mounted within the base and the fixture attached to a front surface of the base. The translucence or semi-translucence of the fixture creates an illumination effect due to limited transmission of light, emitted from the light source, through the feature. The water feature may take on a variety of forms, including, for example, decorative fixtures, receptacles, a bowl-shaped fixture, and a hand grip attached to a structural surface of a pool, spa or fountain.

4 Claims, 9 Drawing Sheets

SELECTIVELY ILLUMINABLE DECORATIVE FIXTURE ASSEMBLIES FOR POOLS, SPAS AND FOUNTAINS

FIELD OF THE INVENTION

The present invention relates to decorative fixtures used with swimming pools, spas and fountains and, more particularly, is concerned with illuminable decorative fixture assemblies for pools, spas and fountains.

BACKGROUND OF THE INVENTION

Various types of decorative fixtures (alternatively referred to as "features" and "accents") are currently used in the swimming pool, spa and fountain industry. These fixtures may come in any number of forms, shapes and sizes. For example, some common fixtures are in the form of a lion head, decorative rosettes, wall sconces, spill bowls, whimsical characters and the like. In many applications these fixtures interact with the water, for example, contained within a pool, spa or fountain. For instance, a continuous stream of water may be provided shooting out of the mouth of a lion head form, or a wall sconce or spill bowl may be continuously filled with water and, in turn, continuously flow/spill out of the fixture and into a body of water of a pool, spa or fountain. The water interaction with these decorative fixtures is usually accomplished through the plumbing of the pool, spa or fountain; such that while a water pump is running it also feeds water to the decorative fixture.

These decorative fixtures are normally constructed from a molded resin composition mixed with real metallic powder (e.g., copper, bronze, silver, brass, etc.) to create a faux finish having a realistic appearance, i.e., as if the fixture was actually constructed from the particular respective metal. In a preferred implementation, the mixed composition is formed as an outer layer of a translucent fixture base portion. A patina may also be applied to this finish to provide an aged or antiquated look.

These decorative fixtures usually look great during daytime hours, since they are clearly visible under sunlight. However, as nightfall approaches, these conventional fixtures are no longer visible without directing an artificial external beam of light on the feature.

Accordingly, there remains a need in the art for an innovation that will overcome the deficiencies of these past approaches and the problems that remain unsolved. In particular, it would be highly desirable to provide such decorative water features that incorporate integral lighting features such that the decorative water features can be viewed, and thereby enjoyed, by individuals during both the daytime and evening.

SUMMARY OF THE INVENTION

The present invention provides an innovation in the form of decorative fixture assemblies for pools, spas and fountains that allow viewing the fixtures of the assemblies during both daytime and nighttime hours, thereby overcoming the limitations of conventional water features.

In one implementation, a backlit decorative fixture assembly includes:

a base having at least one passageway therethrough with a front opening, wherein the base could comprise an individual component of the fixture or, alternatively, an existing surface of, for example, a side wall of a pool, spa or fountain;

a casing having a hollow socket mounted in the one passageway of the base, the hollow socket having a front opening at a front end thereof;

a light source received in and mounted to hollow socket of the casing and being configured to emit light through the front opening at the front end of the hollow socket of the casing; and a fixture at least partially semi-transparent mounted to the base so as to overlie the front opening of the one passageway of the base, the front opening of the hollow socket of the casing in the one passageway of the base, and the light source in the hollow socket of the casing, so as to restrict the emission of light from the light source from passing therethrough and thereby illuminating the fixture.

In an aspect, the hollow socket of the casing may have a ledge recessed in the front end of the hollow socket so as to surround the front opening at the front end of the hollow socket. Also, the light source may include a front end and a front rim attached on the front end of the light source, so as to surround and extend outward from the front end of the light source such that the front rim is seated on the ledge recessed in the front end of the hollow socket of the casing.

In another aspect, the base may include spaced-apart front and rear surfaces, the one passageway being defined through the base between the front and rear surfaces. Also, the base may be a portion of a component of at least one of a swimming pool, a spa and a fountain.

In another implementation, a backlit decorative fixture assembly includes:

a base having a passageway therethrough with a front opening to the passageway, the base also having a front surface surrounding the front opening of the passageway;

a casing having a hollow socket mounted in the passageway of the base, the hollow socket having a front opening at a front end thereof;

a light source received in and mounted to the hollow socket of the casing and being configured to emit light through the front opening at the front end of the hollow socket of the casing; and a fixture in the form of a hand grip constructed from a material at least partially semi-transparent attached to the front surface of the base so as to overlie the front opening of the passageway of the base, the front opening of the hollow socket of the casing in the passageway of the base and the light source in the hollow socket of the casing, so as to restrict the transmission of light emitted from the light source from passing therethrough and thereby illuminating the hand grip.

In another aspect, the front surface of the base has a recess formed therein so as to surround the front opening of the passageway. Also, the hollow socket of the casing is fitted through the front opening to within the passageway of the base. The casing may include a front face plate attached on the front end of the hollow socket so as to surround and extend outward from the front opening at the front end of the hollow socket such that the front face plate is seated in the recess in the front surface of the base.

In another aspect, the fixture may include a rear portion and a hand grip portion, wherein the hand grip is mounted to, or integral with, the front surface of the base so as to overlie the front opening of the passageway of the base, the front opening of the hollow socket of the casing in the passageway of the base, and the light source in the hollow socket of the casing, so as to restrict transmission of light emitted from the light source therethrough, thereby illuminating the hand grip.

In another implementation, a selectively-illuminable water feature is provided, including:

a bowl-shaped fixture adapted for being mounted upon a horizontally-oriented support surface over a niche extending into the support surface, the bowl being at least semi-translucent and generally defined by a contiguous sidewall terminating upwardly at an upper lip and extending downwardly toward, and transitioning into, a generally planar base portion, the upper lip having an integral recessed portion functioning as a spout, the planar base having a central aperture extending therethrough and an annular cavity provided in a lower surface thereof surrounding the central aperture;

an annular lighting source positioned beneath a lower surface of the bowl-shaped fixture, the lighting source sized and shaped to conform with and be seated within the annular cavity of the fixture base;

a niche having a base sized and shaped to conform with the support surface aperture, a top side of the niche extending outwardly slightly beyond the housing base to define a peripheral flange, a central aperture extending completely through the niche; and a water communicating conduit extending upwardly through the support surface aperture, through the niche central aperture, through the annular lighting source, and through the central aperture of the bowl planar base, an upper end of the conduit terminating an upper edge within the bowl-shaped fixture;

wherein, a continuous flow of water introduced into said bowl fixture causes a continuous flow of water out of the bowl over the spout portion of the bowl lip, and light emitted from said light source effecting colored lighting of said bowl-shaped fixture, such that, in a semi-dark or dark environment selective flickering of the light source creates the effect of a flame about said bowl-shaped fixture.

In an aspect, an additional aperture is provided extending through the niche, and an electrical wire is provided having a first end in electrical communication with an electrical power source, the electrical wire extending completely through the niche and a second end of the electrical wire is in electrical communication with the annular light source.

In another aspect, the annular light source is fixedly integrated into the annular cavity provided in the lower surface of the planar base of the bowl-shaped fixture.

In another aspect, the annular light source is fixedly attached to an upper surface of the niche such that, upon positioning the bowl-shaped fixture upon the support surface, the light source snugly seats within the corresponding annular cavity provided in the lower surface of the planar base of the bowl-shaped fixture.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
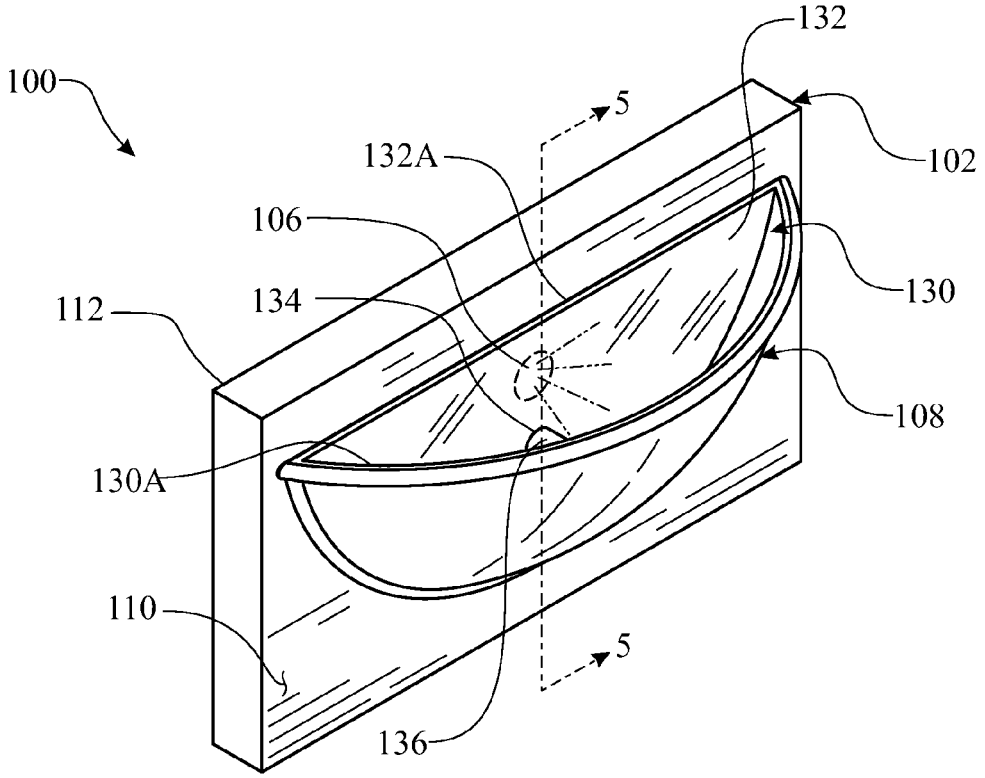
FIG. 1 presents a top front isometric view of a fully-assembled backlit decorative fixture assembly in accordance with a first exemplary implementation of the present invention.
Figure 2:
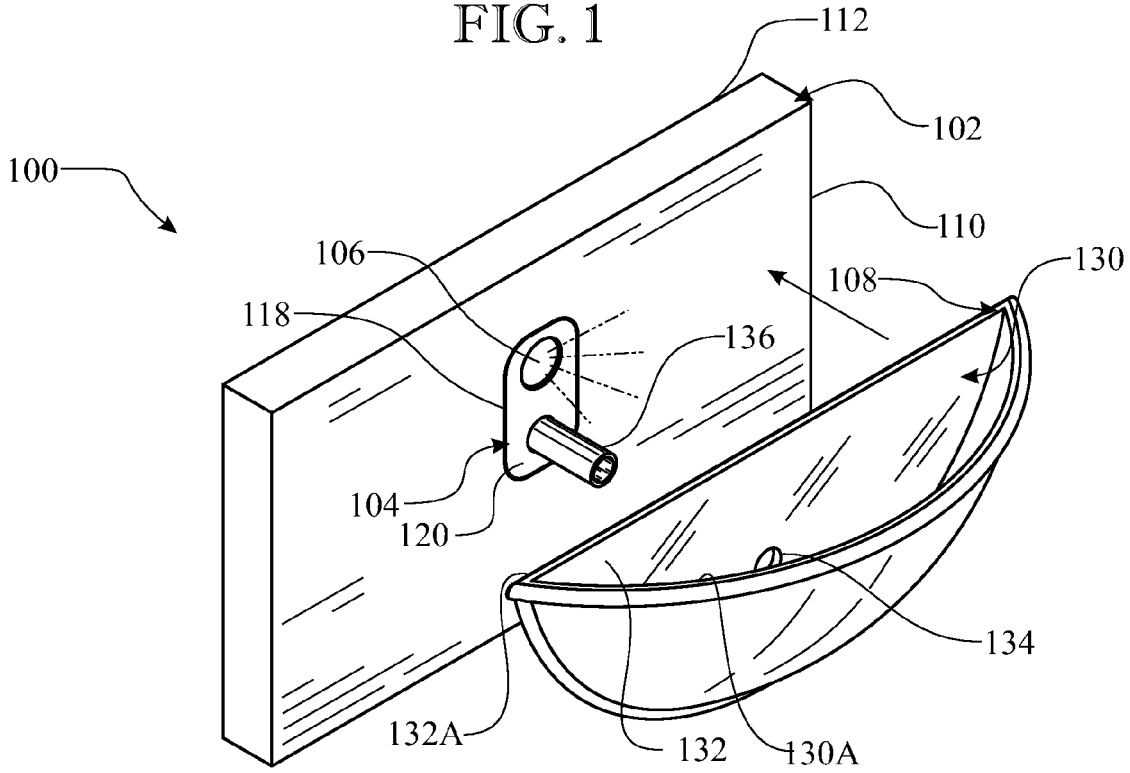
FIG. 2 presents a top front isometric view of the fixture assembly shown in FIG. 1 with the fixture separated from the mounting portion to expose the mounting structure.
Figure 3:
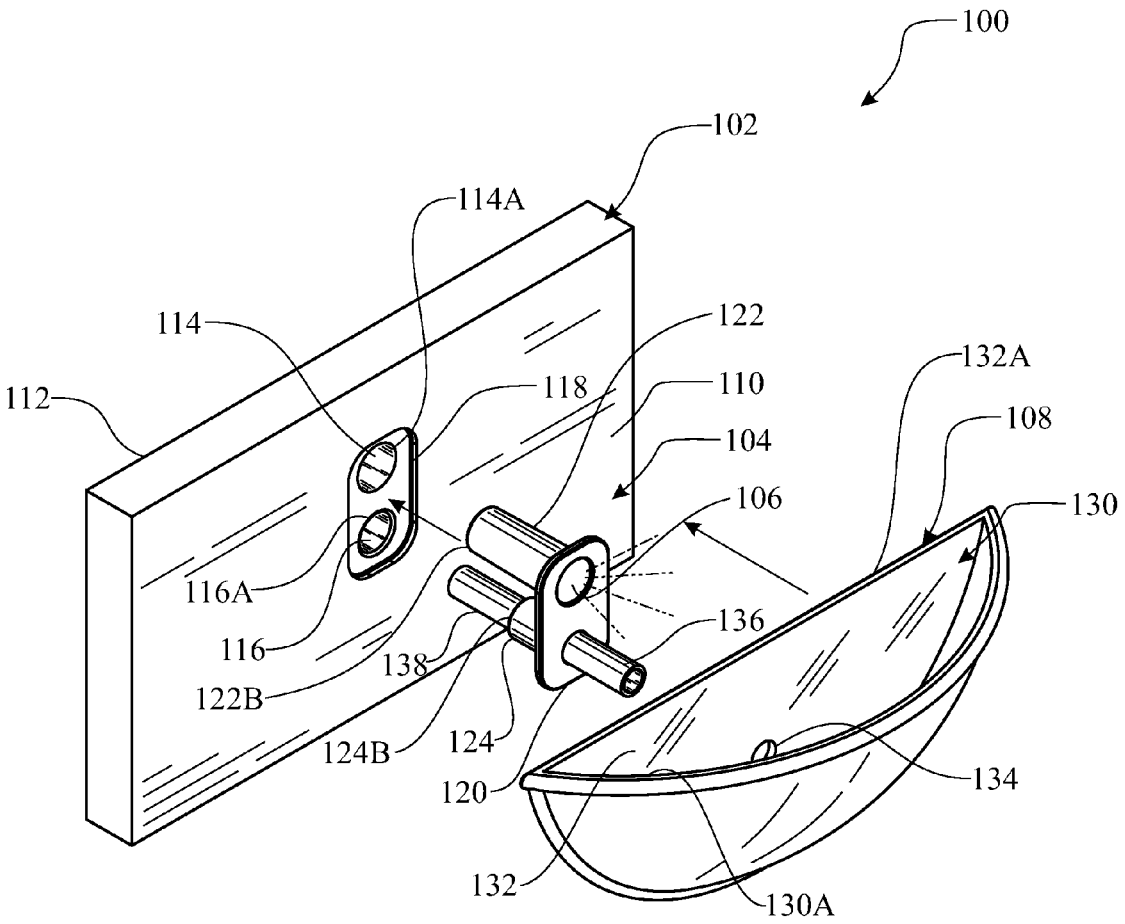
FIG. 3 presents a top front isometric partially-exploded view of the fixture assembly shown in FIG. 1.
Figure 4:
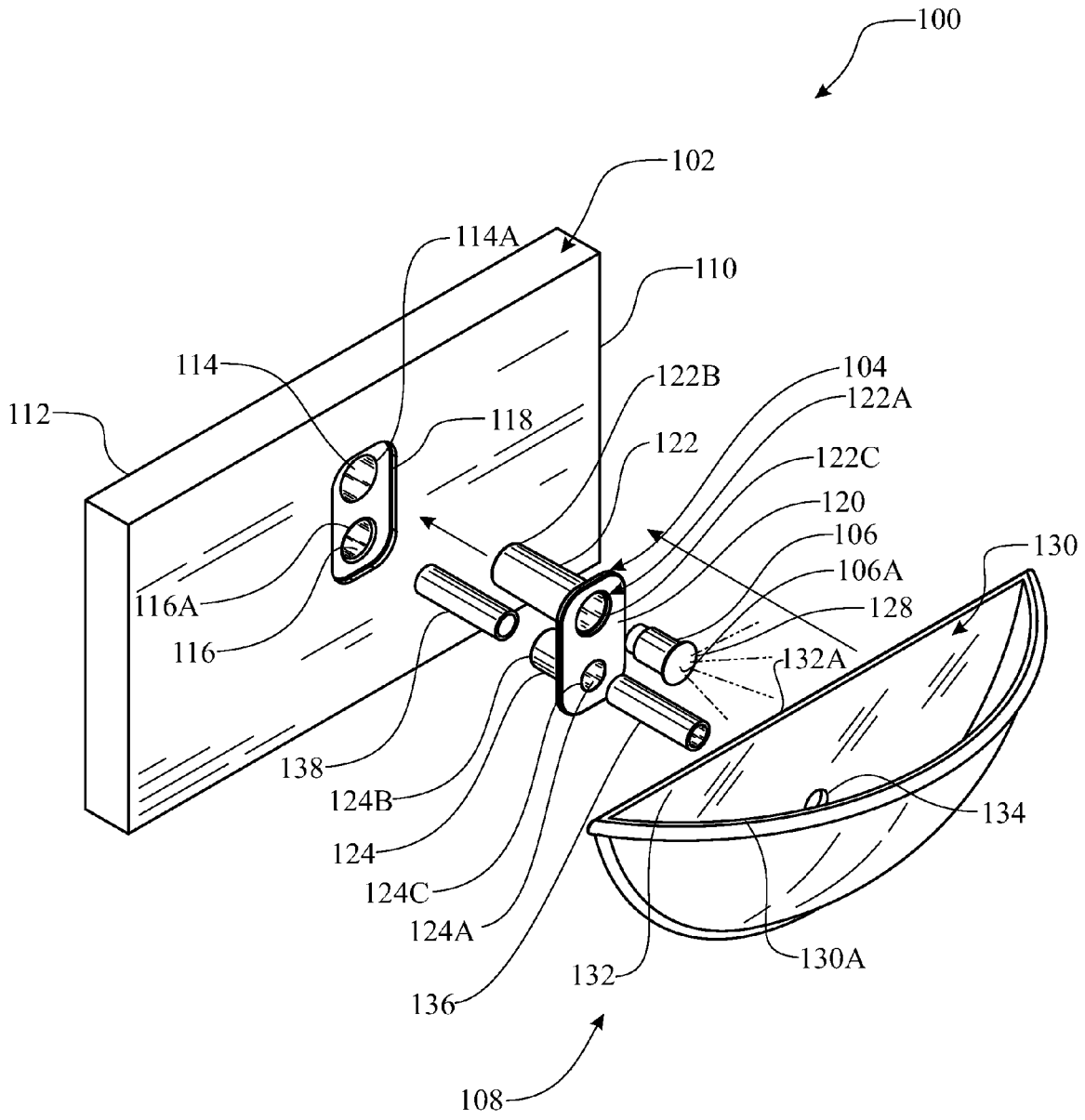
FIG. 4 presents a top front isometric fully-exploded view of the fixture assembly shown in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-5, there is illustrated a first exemplary implementation of a backlit decorative fixture assembly, generally designated 100, in accordance with the present invention. The fixture assembly 100 includes a base 102, a niche/casing 104, a light source 106 and a fixture 108. The base 102 of the fixture assembly 100 has spaced-apart opposite front and rear surfaces, 110 and 112, respectively, and at least one passage, but preferably a pair of passageways 114, 116 extending through the base 102 from the front surface 110 to the rear surface 112. The passageways 114, 116 are spaced apart from, but in close proximity or adjacent to, one another in a given spaced-apart relationship such as, by way of example but not of limitation, a center-to-center spacing of one-to-two inches. The passageways 114, 116 have opposite front and rear openings, 114A and 114B, and 116A and 116B, respectively, provided in the respective front and rear surfaces, 110 and 112, respectively, of base 102. The rear surface 112 of the base 102 may be configured to make contact with and attach, for example, adhesively, to a surface of a component (not shown), such as a wall. Again, as will be apparent to those skilled in the art, the base 102 could be an individual subcomponent of the assembly or, alternatively, the base 102 could actually comprise the wall of a pool, spa, fountain or the like. To reiterate, where the base is an individual component or portion of the fixture assembly, attachment to an existing surface, such as a pool wall, may be achieved by use of any suitable conventional adhesive. Or, the base 102 may actually comprise an existing component, such as a wall of a swimming pool, a spa, a fountain or the like. The base 102 may be fabricated from the same materials as the pool, spa and/or fountain wall. The base 102 may include a recess 118 provided in the front surface 110 so as to surround the front openings 114A, 116A of the respective passageways 114, 116.

Figure 5:
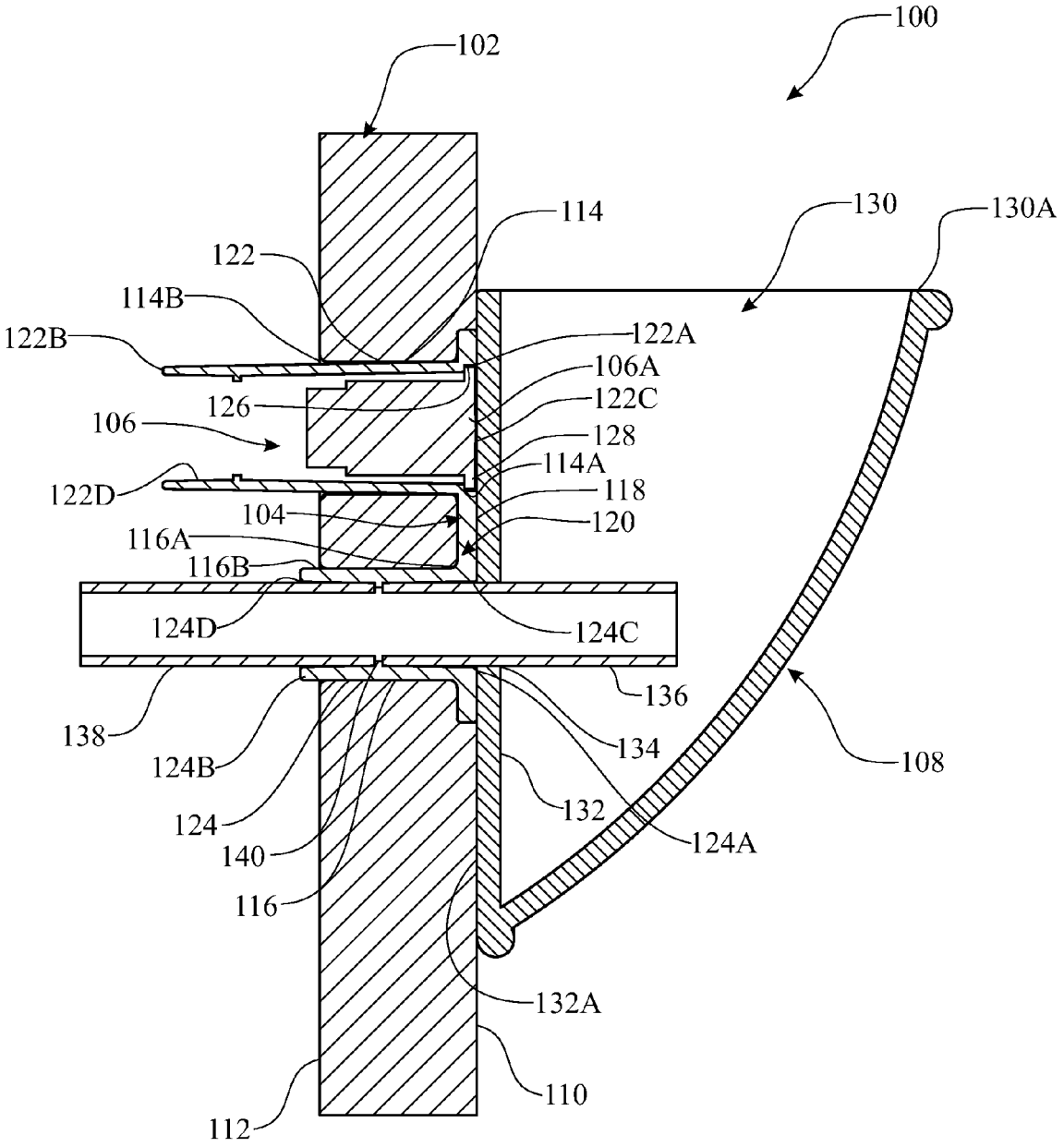
FIG. 5 presents an enlarged vertical sectional view of the fixture assembly depicted in FIGS. 1-4, taken along line section line 5-5 of FIG. 1.

The casing 104 of the fixture assembly 100 includes a front face plate 120 and a hollow socket 122 and a hollow sleeve 124 attached to and extending rearwardly from the front face plate 120. The hollow socket 122 and hollow sleeve 124 are spaced apart from, but in close proximity or adjacent to one another in a relationship that corresponds to the given spaced relationship of the passageways 114, 116, and have sizes corresponding to sizes of the passageways 114, 116, such that the hollow socket 122 and hollow sleeve 124 snugly fit in the passageways 114, 116, as best seen in FIG. 5. The hollow socket 122 and hollow sleeve 124 have respective front ends, 122A and 124A, and respective rear ends 122B and 124B. The hollow socket 122 and hollow sleeve 124 have respective front openings 122C and 124C, and respective rear openings 122D and 124D. The front face plate 120 attaches to, or is integral with, the hollow socket and sleeve 122, 124 at the respective front ends 122A, 124A thereof so as to surround and extend outward from the respective front openings 122C, 124C of the hollow socket and sleeve 122, 124, such that the front face plate 120 conforms with, and snugly seats within, the recess 118 in the front surface 110 of the base 102.

The light source 106 is received in and mounted to the hollow socket 122 of the casing 104. The light source 106 is configured to emit light through the front opening 122C at the front end 122A of the hollow socket 122 of the casing 102. The light is emitted forwardly away from the front surface 110 of the base 102, into and at least partially through, the fixture 108. The hollow socket 122 of the casing 104 has a circumferential ledge 126 recessed in the front end 122A of the hollow socket 122, so as to surround the front opening 122C at the front end 122A of the hollow socket 122. The light source 106 has a front end 106A and a circumferential front rim 128 attached on or integrated with the front end 106A so as to surround and extend outward from the front end 106A of the light source 106. The circumferential front rim 128 is seated on or engaged against the circumferential ledge 126 recessed in the front end 122A. As shown, it is preferable that the exterior-facing surface of light source front rim 128 is planar to facilitate flush engagement against the rear surface 132A of receptacle 108. The light source 106 may be of any suitable conventional type, such as, by way of example but not of limitation, an incandescent lamp, LED and fiber optic type light source.

The fixture 108 is in the form of a decorative receptacle made of a semi-transparent or transparent material. The receptacle 108 defines an interior cavity 130 having an open top 130A. Also, the receptacle 108 has a rear portion 132 with a rear surface 132A configured to abut up against and attach to the front surface 110 of the base 102. Attachment may be achieved, for example, by use of any suitable conventional adhesive. As can be readily understood from FIGS. 1 and 5, the rear surface 132A of the rear portion 132 of the receptacle 108 surrounds and overlies the front openings 114A, 116A of the passageways 114, 116 of the base 102, the front face plate 120 of the casing 104 in the recess 118 in the front surface 110 of the base 102, the front openings 122C, 124C of the hollow socket and sleeve 122, 124 of the casing 104 in the respective passageways 114, 116 of the base 102, and the light source 106 in the hollow socket 122 of the casing 104. In such position, the rear portion 132 of the receptacle 108 restricts, at least to some degree, the transmission of light emitted from the light source 106 therethrough, thereby causing illumination of the decorative receptacle 108. The rear portion 132 of the receptacle 108 may also include an aperture 134 extending therethrough, which opens into and communicates with the interior cavity 130 of the receptacle 108 such that at least one conduit, and preferably a pair of front and rear conduits, 136 and 138, respective is/are received through the hollow sleeve 124 of the casing 104 and the aperture 134 in the rear portion 132 of the receptacle 108 for supplying a flow of liquid, such as water, into the interior cavity 130 of the receptacle 108. The front and rear conduits, 136 and 138, respectively, abut against opposite sides of a circumferential shoulder 140 formed about the interior of the hollow sleeve 124 at an intermediate location between the front and rear ends, 124A and 124B, respectively, thereof.

Figure 6:
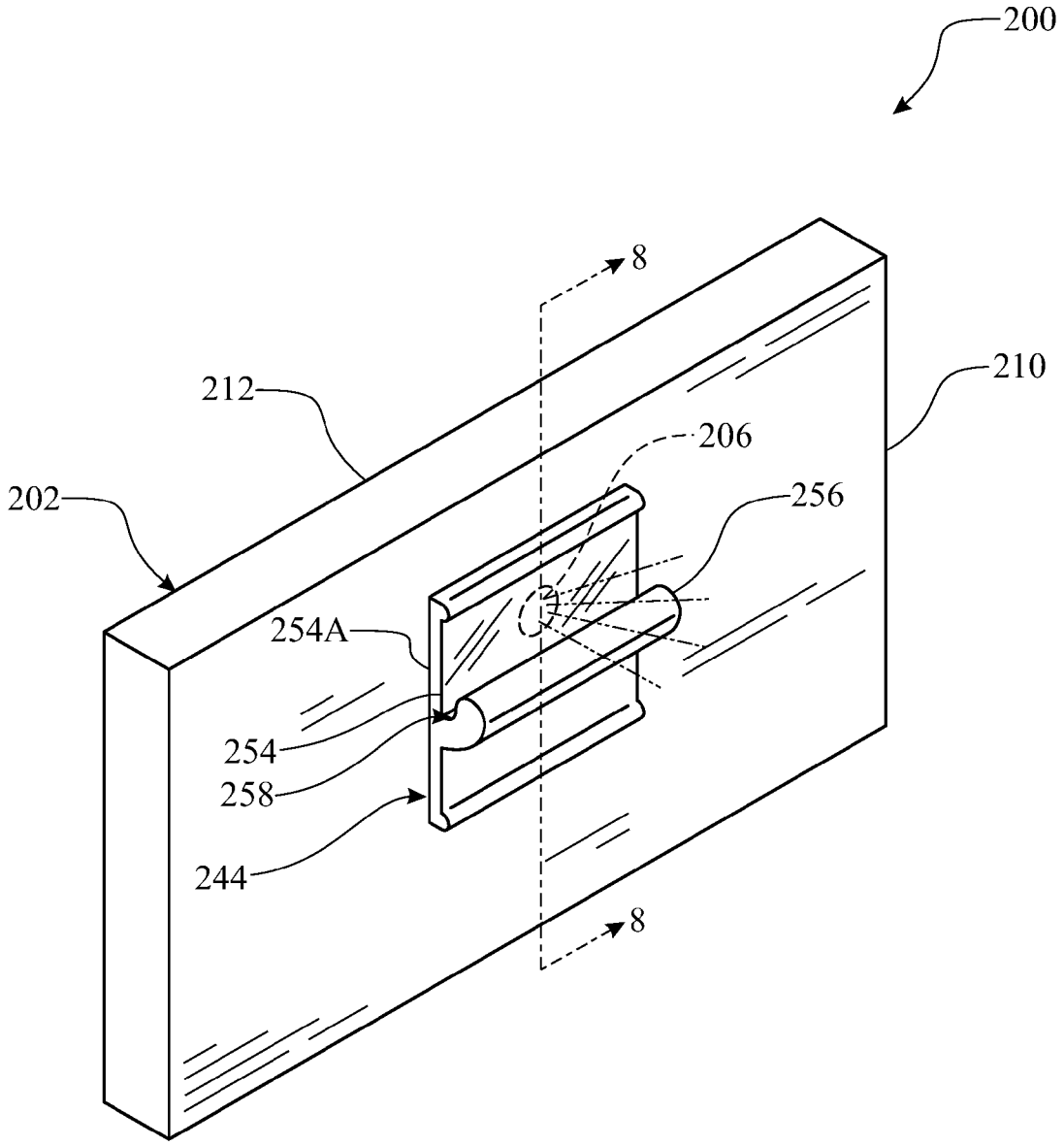
FIG. 6 presents a top front isometric view of a fully-assembled backlit decorative fixture assembly in accordance with a second exemplary implementation of the present invention.
Figure 7:
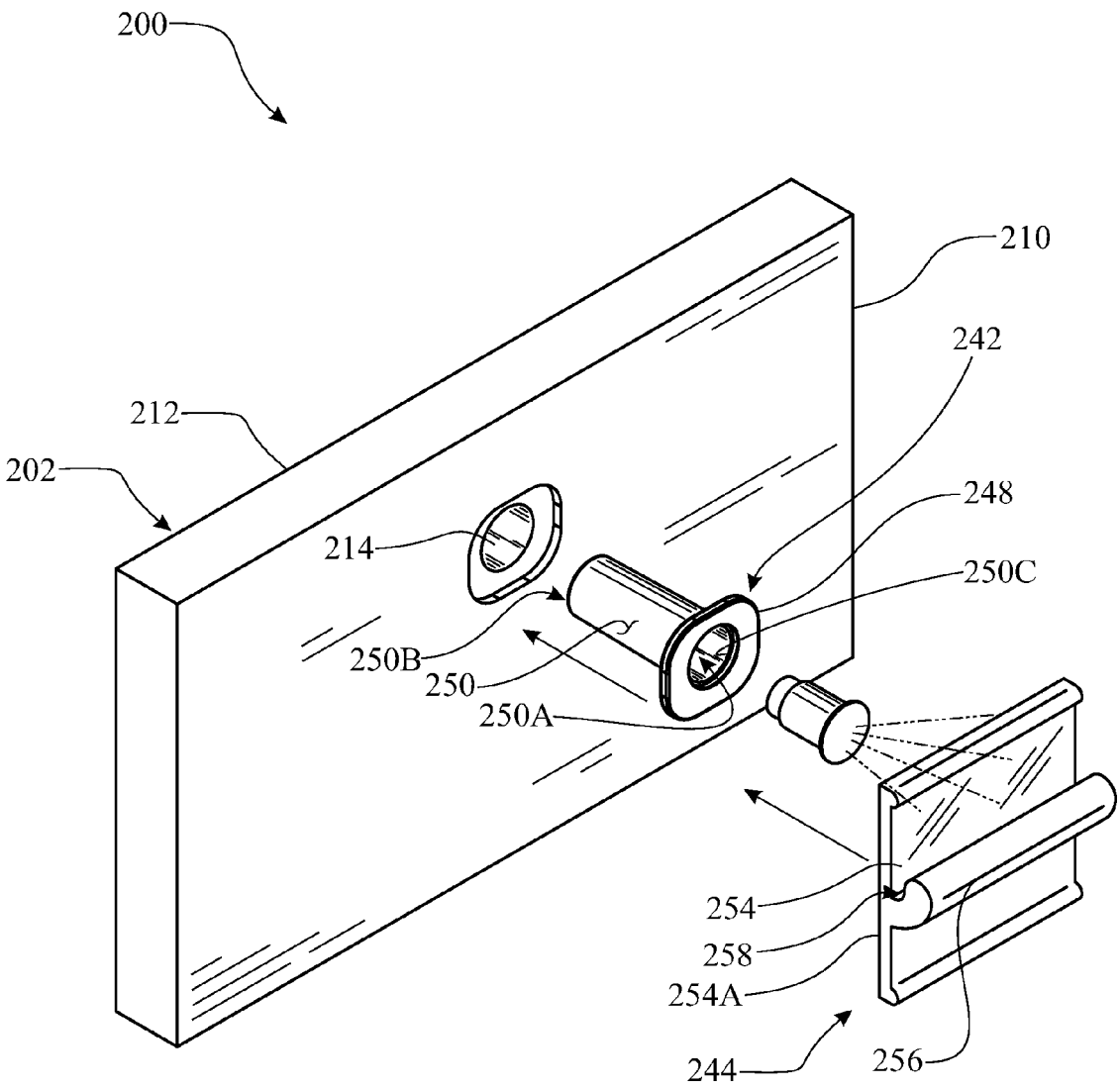
FIG. 7 presents a fully-exploded top front isometric view of the fixture assembly of FIG. 6.
Figure 8:
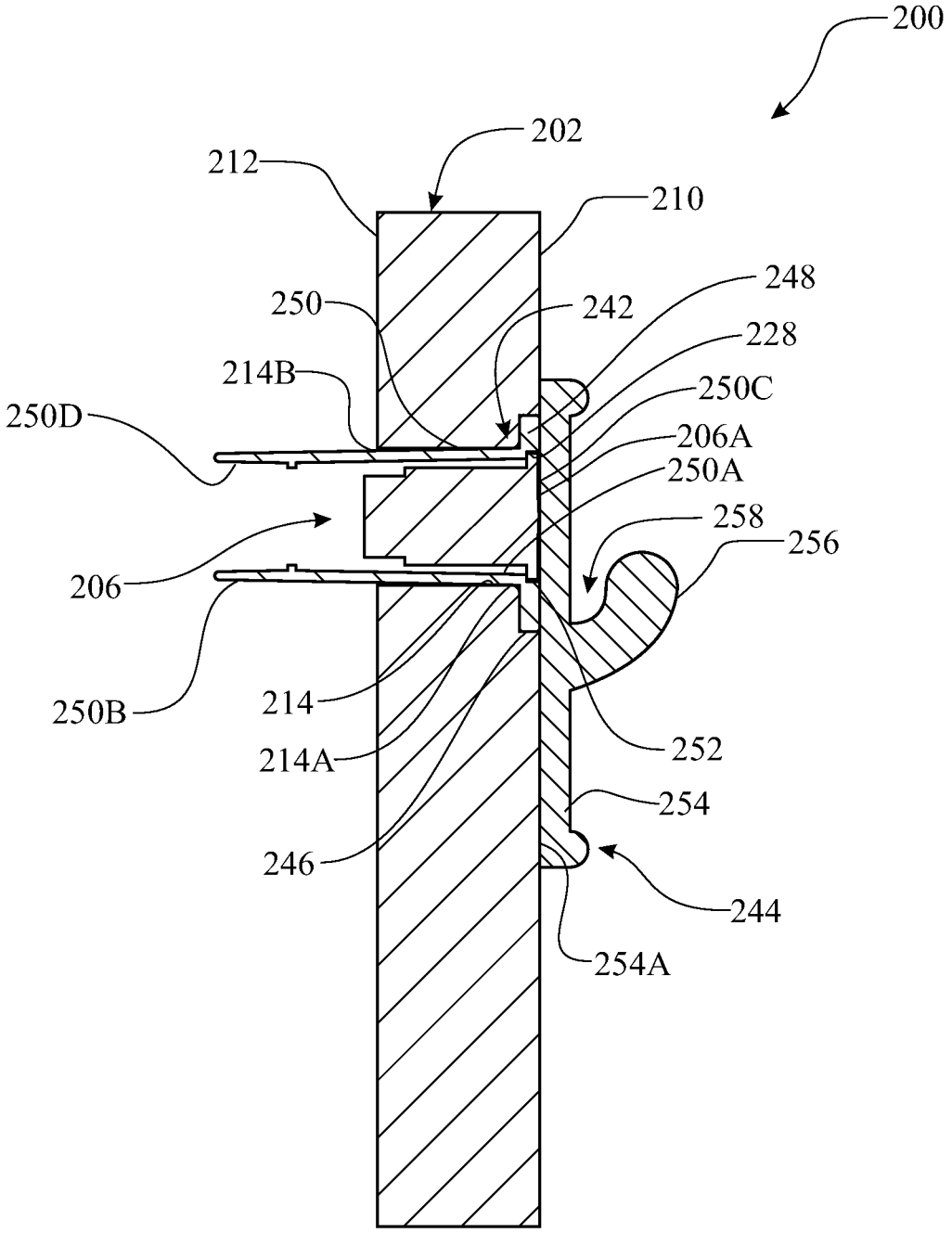
FIG. 8 presents an enlarged vertical sectional view of the fixture assembly depicted in FIGS. 6-7, taken along line section line 8-8 of FIG. 6.
Figure 9:
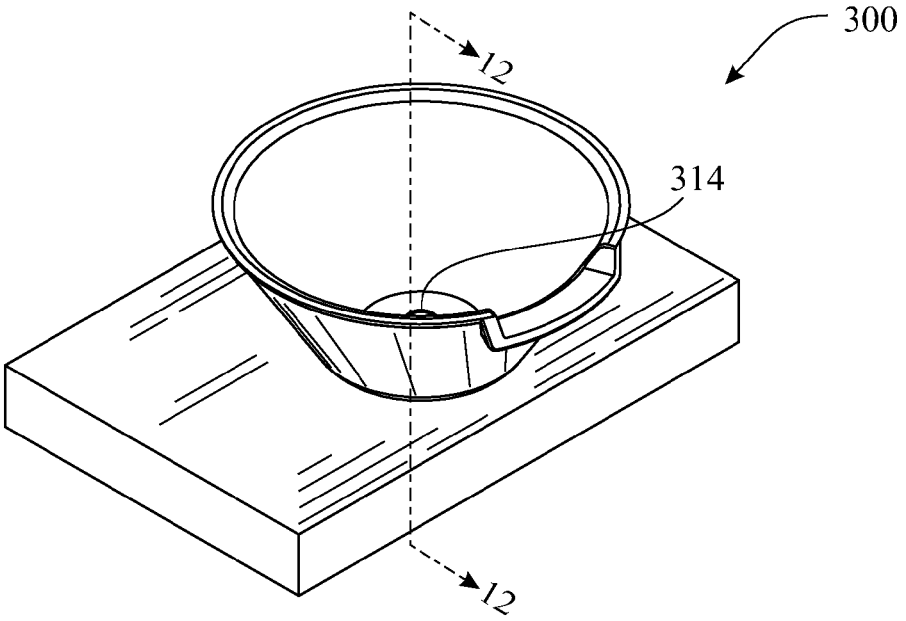
FIG. 9 presents a top front isometric view of a fully-assembled selectively-illuminable fire bowl-type fixture in accordance with a third exemplary implementation of the present invention.
Figure 10:
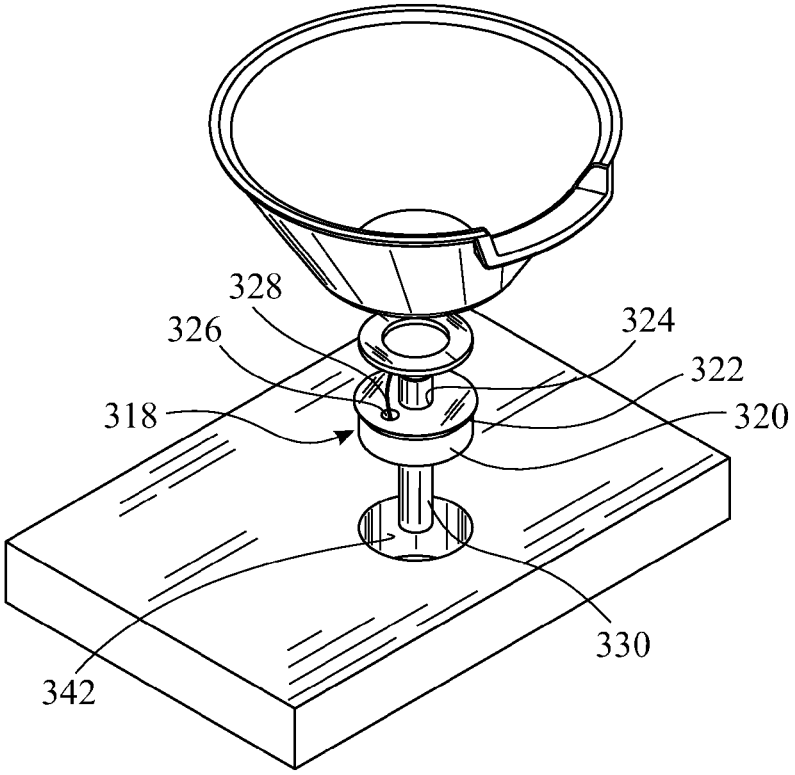
FIG. 10 presents a fully-exploded top front isometric view of the assembly shown in FIG. 9.

Referring now to FIGS. 6-8, there is illustrated a second exemplary implementation of a backlit decorative fixture assembly, generally designated 200, in accordance with the present invention. Like features of the backlit decorative fixture assemblies, 100 and 200, are numbered the same, except preceded by the numerals "1" and "2," respectively. The fixture assembly 200 includes a base 202, a casing/niche 242, a light source 206 and a fixture 244.

The base 202 of the fixture assembly 200 has spaced apart opposite front and rear surfaces, 210 and 212, respectively, and a passageway 214 defined through the base 202 extending between the front surface 201 and the rear surface 212. The passageway 214 has opposite front and rear openings, 214A and 214B, respectively, at the respective front 210 and rear 212 surfaces of the base 202. The rear surface 212 of the base 202 is configured to make contact with and attach to a surface of a component (not shown), such as a wall. Attachment may be achieved by use of any suitable conventional adhesive. Alternatively, the base 202 may actually comprise a portion of an existing structure or component, such as an interior wall of a swimming pool, a spa and/or a fountain. The base 202 may be fabricated from the same materials as the pool, spa and/or fountain wall. The base 202 preferably includes a recess 246 provided in the front surface 210 so as to surround the front opening 214A of the passageway 214.

The casing 242 of the fixture assembly 200 includes a front face plate portion 248 and a hollow socket portion 250 attached to, or integral with, and extending rearwardly from the front face plate 248. The hollow socket 250 has a size, or external diameter, corresponding to, or slightly less than the size, or diameter, of the passageway 214, such that the hollow socket 250 fits snugly within the passageway 214, as best seen in FIG. 8. The hollow socket 250 has front and rear ends, 250A and 250B, respectively, and front and rear openings, 250C and 250D, at the respective front and rear ends. The front face plate 248 attaches with, or is integral with, the hollow socket 250 at the front end 250A thereof, so as to surround and extend outward from the front opening 250C of the hollow socket 250, such that the front face plate 248 snugly seats in the recess 246 in the front surface 210 of the base 202.

The light source 206 is received into and mounted within the hollow socket 250 of the casing 242. The light source 206 is configured to emit light through the front opening 250C at the front end 250A of the hollow socket 250 of the casing 242. The light is emitted forwardly away from the front surface 210 of the base 202, into and at least partially through the fixture 244. The hollow socket 250 of the casing 242 has a circumferential ledge 252 recessed in the front end 250A of the hollow socket 250 so as to surround the front opening 250C at the front end 250A of the hollow socket 250. The light source 206 has a front end 206A and a circumferential front rim 228 attached on, or integral with, the front end 206A so as to surround and extend outward from the front end 206A of the light source 206. The circumferential front rim 228 is seated on the circumferential ledge 252 recessed in the front end 250A of the hollow socket 250 of the casing 242. The light source 206 may be of any suitable conventional type, such as, by way of example but not of limitation, an incandescent lamp, LED, and fiber optic light, to name just a few.

The fixture 244 is in the form of a hand grip constructed from a semi-transparent or transparent material. The hand grip 244 has a rear portion 254 with a rear surface 254A configured to abut up again and attach to the front surface 210 of the base 202. Attachment may be achieved by use of any suitable conventional adhesive. Again, as will be readily apparent to those skilled in the art, base 202 may be an existing structure such as the wall of a pool, spa or fountain. Referring particularly to FIGS. 6 and 8, the rear surface 254A of the rear portion 254 of the hand grip 244 surrounds and overlies the front opening 214A of the passageway 214 of the base 202, the front face plate 248 of the casing 242 in the recess 246 in the front surface 210 of the base 202, the front opening 250C of the hollow socket 250 of the casing 242 in the passageway 214 of the base 202, and the light source 206 in the hollow socket 250 of the casing 242. In this position and orientation, the rear portion 254 of the hand grip 244 at least partially restricts the transmission of light emitted from the light source 206 therethrough, thereby causing illumination of the hand grip 244. The fixture 244 preferably includes an integral hand grip portion 256 integrally formed with, or attached to, and extending from the rear portion 254 so as to define a lateral channel 258 between the hand grip portion 256 and the rear portion 254. The channel 258 is open along its top to facilitate gripping, for example, by the hand of an individual, for example, within a swimming pool.

As mentioned above with respect to fixtures 108, fixture 244 is preferably constructed having a clear of transparent base having a semi-transparent outer layer, with an optional faux metal finish layer either formed thereon during a molding operation or applied thereto following molding of a transparent (clear) core. It is then possible to illuminate the fixture from behind and thereby allow the fixture to be viewed at night. The fixture now maintains a desired aesthetic appearance (e.g., metallic copper, bronze, silver or brass) during the daylight, while transforming at nighttime to glow any of a number of colors, selectively maintaining all the detail of the decorative fixture. It would also be possible for the decorative fixture to be "synced" with the pool, spa or fountain lights so that, for example, if the pool lights are white, blue, etc., the decorative fixture would be white, blue, etc. It is now also possible to illuminate the water stream coming from behind or inside the fixture assembly, such that it creates the effect of the water being the same color.

As will be apparent to those skilled in the art, any of a variety of well-known manufacturing processes, including, for example, injection molding, could be utilized in the construction of the fixtures exemplified herein by reference numerals 108, 244 and 302. A preferred method of manufacturing the fixtures in the form of molded resin products incorporates a process including the steps of: (a) mixing a clear, or transparent, base resin with any one of several commercially available metal powders (e.g., copper powder, silver powder, brass powder and bronze powder), until a desired color is achieved, or, alternatively to the use of metal powder, a color pigment could be incorporated, either alone or in combination with the metal powder, to effectively tint the base resin; (b) depositing the mixture created in step (a) to an interior surface of a fixture mold to form an outer layer and, optionally, if necessary, curing or partially curing the deposited mixture layer; (c) filling the coated mold with a volume of a clear, or translucent, non-colored and non-tinted composition of the desired resin product and, optionally, if necessary, curing the translucent composition, thereby a clear solid fixture form having a tinted or colored exterior layer, or finish, which is at least semi-transparent to enable a back light to shine through the product that results in lighting of the fixture. As will be apparent to those skilled in the art, this preferred method is merely an example of a manufacturing process. For instance, an alternative processes could initially mold the desired fixture form using a clear, or translucent, compositions, which, upon curing or semi-curing, could be removed from the mold and subsequently coated through application of, for example, a colored gel-coat finish, a painted finish, an air-brushed finish or any other available deposition method.

Referring now to FIGS. 9-12, in a further implementation of the invention a so-called fire bowl fixture assembly 300 is provided for mounting upon a horizontal support surface 340, preferably adjacent to a body of water such as a pool. Assembly 300 generally includes: a bowl 302; a lighting source 316; a niche 318 sized and shaped to conform to an opening or receiving cavity 342, extending through the support surface 340; and a water conduit 330.

Figure 11:
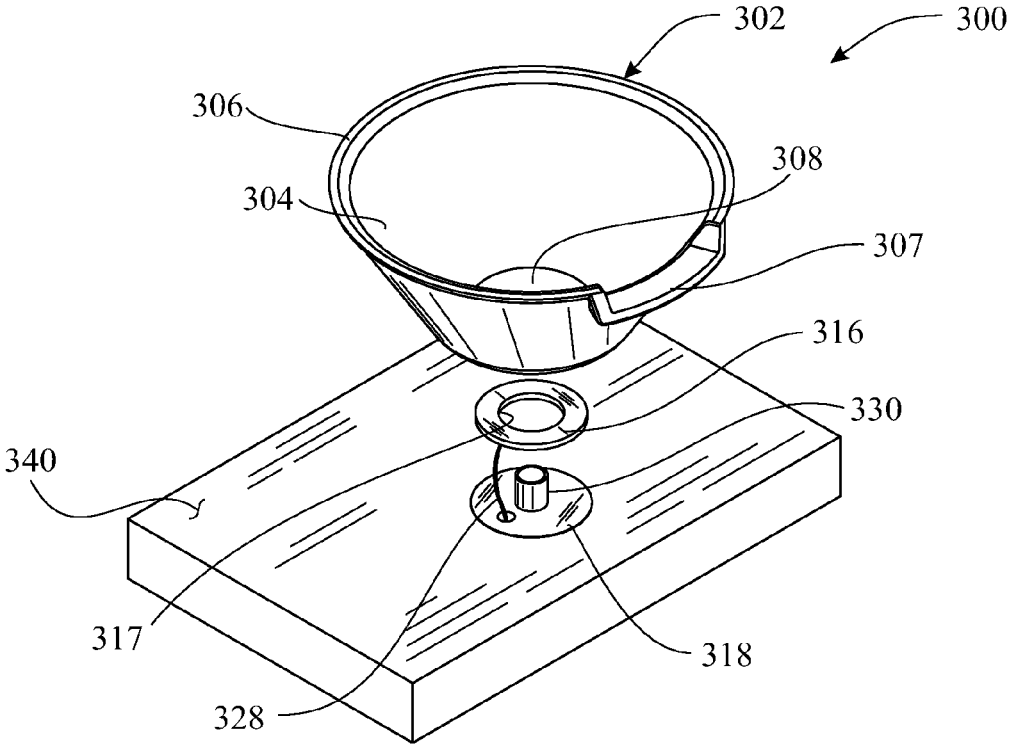
FIG. 11 presents a partially-exploded top front isometric view of the assembly shown in FIG. 9 shown partially installed on to a support surface.
Figure 12:
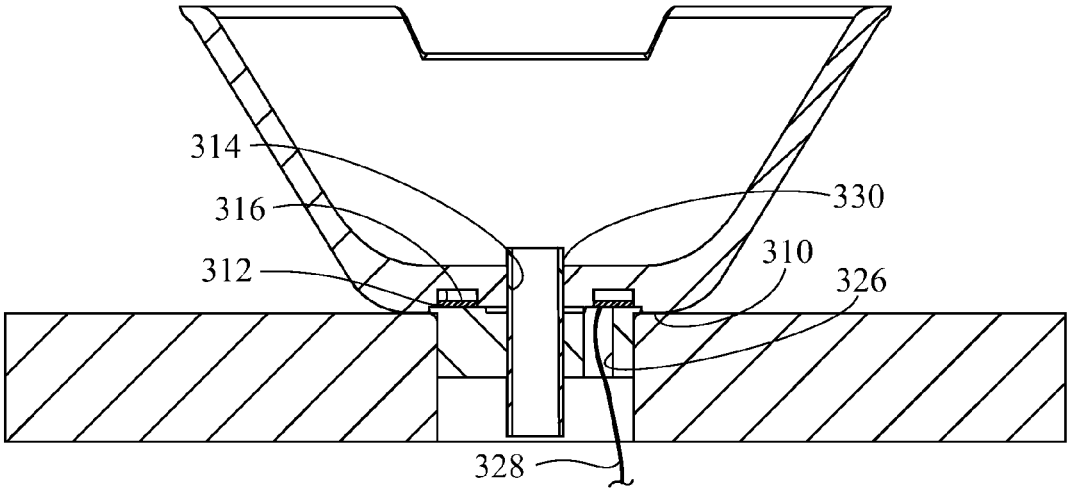
FIG. 12 presents an enlarged cross-sectional view taken along section line 12-12 of FIG. 9.

As best shown in FIG. 11, translucent or semi-translucent bowl 302 includes a sidewall 304, an upper lip 306, and a base 308 having a central aperture 314 extending therethrough. A lower surface of base 308 has an annular cavity 312 surrounding central aperture 314 for receiving lighting source 316 therein. Lighting source 316 may be provided integrated into annular cavity 312, for example, using an epoxy, silicone or other chemical adhesive. Alternatively, lighting source 316 may be provided independently mounted upon an upper surface of the niche 318 such that it becomes snugly seated within annular cavity 312 of bowl base 308 when the lower surface 310 of the bowl base is rested upon upper support surface 340. Electrical power from an electrical power source (not shown) is transmitted to lighting source 316 via conventional electrical wiring 328 extending through a wire-receiving aperture 326 extending completely niche 318, providing electrical communication between a remote electrical power source (not shown) and the lighting source 316.

A water conduit 330 provides a flow of water from a water source (such as water from an adjacent pool circulated by a water pump) into the interior of bowl 302. Water conduit 330 extends through support surface opening 342, into and through a central aperture 324 extending through niche 318, through a central opening 317 of lighting source 316, and completely through central aperture 314 of bowl base 308. In this manner, a continuous ingress of water into bowl 302 can be selectively maintained to create a corresponding continuous waterfall out of bowl 302 over bowl spout 307.

The niche 318 preferably includes a base portion 320 and an upper flange portion 322 extending slightly outward therefrom, such that the flange portion rests upon the bowl support surface 340 when the assembly is completely assembled and installed against the support surface. As will be apparent to those skilled in the art, as previously mentioned, the lighting source 316 may be integrated directly into the annular cavity 312 of the bowl 302 or installed upon the bowl support surface 340, and the bowl subsequently positioned atop the lighting source such that the lighting source seats within the annular cavity. In either case, it will also be apparent to those skilled in the art that the light source can be selectively controlled via conventional well-known electrical circuitry to enable a user to create a flickering light effect. For instance, a flickering red light can be employed, wherein the transmission of the flickering red light through the translucent or semi-translucent bowl creates a flickering fire or flame visual effect.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A selectively-illuminable water feature, comprising:

a bowl-shaped fixture mounted upon a horizontally-oriented support surface over a niche extending into said support surface, through a support surface aperture the bowl being at least semi-translucent and generally defined by a contiguous sidewall terminating upwardly at an upper lip and extending downwardly toward, and transitioning into, a generally planar base portion, the upper lip having an integral recessed portion functioning as a spout, said planar base having a central aperture extending therethrough and an annular cavity provided in a lower surface thereof surrounding said central aperture;

an annular lighting source positioned beneath a lower surface of said bowl-shaped fixture, the lighting source sized and shaped to be seated within the annular cavity of said fixture base;

the niche having a base portion sized and shaped to conform with the support surface aperture, a top side of said niche extending outwardly slightly beyond said base portion to define a peripheral flange, a central aperture extending completely through the niche; and a water communicating conduit extending upwardly through said support surface aperture, through said niche central aperture, through said annular lighting source, and through the central aperture of said bowl planar base, an upper end of said conduit terminating an upper edge within said bowl-shaped fixture;

wherein, a continuous flow of water introduced into said bowl fixture causes a continuous flow of water out of said bowl over the spout portion of said bowl lip, and light emitted from said light source effects colored lighting of said bowl-shaped fixture, such that, in a semi-dark or dark environment selective flickering of said light source creates the effect of a flame about said bowl-shaped fixture.

2. A selectively-illuminable water feature a recited in claim 1, further comprising:

an additional aperture extending through said niche; and an electrical wire having a first end in electrical communication with an electrical power source, the electrical wire extending completely through said niche, and a second end of said electrical wire in electrical communication with said annular light source.

3. A selectively-illuminable water feature as recited in claim 1, wherein said annular light source is fixedly integrated into the annular cavity of provided in the lower surface of the planar base of said bowl-shaped fixture.

4. A selectively-illuminable water feature as recited in claim 1, wherein said annular light source is fixedly attached to an upper surface of said niche such that, upon positioning said bowl-shaped fixture upon said support surface said light source snugly seats within the corresponding annular cavity provided in the lower surface of the planar base of said bowl-shaped fixture.

* * * * *